United States Patent [19]

Cronan

[11] 4,121,772

[45] Oct. 24, 1978

[54] PORTABLE SPRAY CAN FOR DUAL LIQUIDS

[75] Inventor: Philip J. Cronan, Los Angeles, Calif.

[73] Assignee: Rubin Mandrell, Los Angeles, Calif.; a part interest

[21] Appl. No.: 825,296

[22] Filed: Aug. 17, 1977

[51] Int. Cl.[2] ..... B05B 7/26

[52] U.S. Cl. ..... 239/304; 206/219; 222/145; 239/309

[58] Field of Search ..... 239/304, 307, 308, 309; 206/219; 169/81, 83; 222/80, 145

[56] References Cited

U.S. PATENT DOCUMENTS

| | | | |
|---|---|---|---|
| 2,653,611 | 9/1953 | Smith | 206/219 |
| 3,251,420 | 11/1966 | Rodgers | 239/309 X |
| 3,591,089 | 7/1971 | Cronan | 239/304 |
| 3,718,235 | 2/1973 | Cronan | 239/304 X |
| 3,773,264 | 11/1973 | Cronan | 239/304 |

*Primary Examiner*—Evon C. Blunk
*Assistant Examiner*—Michael J. Forman
*Attorney, Agent, or Firm*—Ralph B. Pastoriza

[57] ABSTRACT

A spray can for resin paints under pressure incorporates a secondary container in its interior mounted to the normally provided elongated spray tube extending into the can. The secondary container holds a catalyst and is closed off at one end by a cap with cooperating plastic sealing members further functioning to hold a weight in such a manner that the weight in the secondary container can be released by shaking of the can to generate an inertial force. Releasing of the weight shatters the secondary container thereby placing the catalyst and resin in communication with each other, the mixture passing up through the tube and out the normally provided spray outlet when the spray valve is opened.

1 Claim, 4 Drawing Figures

PORTABLE SPRAY CAN FOR DUAL LIQUIDS

This invention relates to an improved spray can for holding chemicals which must normally be maintained in a separated condition until immediately prior to use.

BACKGROUND OF THE INVENTION

In spraying resin-type paints or other chemicals onto work surfaces to provide a hard resinous surface, the materials making up the spray must normally be kept in separate containers. One container might hold a resinous paint and the other container a catalyst. When the resin and catalyst are mixed together, they chemically interact to result in a hardened finished coating. Normally, the chemicals are corrosive and it is extremely important that they be maintained in hermetically separated states until just prior to use.

In an actual spraying operation, suitable outlets from the separate containers pass into a common chamber in a spray nozzle and the mixture is then caused to be sprayed from the nozzle under a high-pressure source such as might be provided by a spray pump.

In recent years there has been introduced on the market paint spraying devices which take the form of only a single container including a paint under pressure to be sprayed. This portable type sprayer eliminates the need for auxiliary spray pumps and the like. However, such containers including a paint under pressure are not suitable for resinous-type paints for providing plastic coatings wherein two chemical ingredients must be mixed together immediately prior to spraying. Attempts to solve the problem have taken the form of a can containing at least two compartments which are sealed from each other. The catalyst and resinous materials are placed in the compartments respectively and caused to be mixed immediately prior to use. Such devices as have been provided heretofore, however, are relatively expensive to manufacture in large quantities primarily because of difficulties in forming the dual compartment container itself.

To overcome the foregoing problems, applicant devised a portable paint spray device permitting the spraying of resinous-type paint from a single can incorporating a secondary container but arranged in such a manner that the device can be relatively economically manufactured.

More particularly, such a portable spray means is disclosed and claimed in my prior U.S. Pat. No. 3,591,089 wherein a can is provided with a frangible secondary container in the interior thereof. An inertia means is provided in the secondary container such that by shaking the can, the inertia means shatters the secondary container. Chemicals in the can and secondary container may then be mixed together and both pass out through the normally provided spray tube to effect the desired spraying operation.

Because of the highly corrosive nature of the catalyst material in the secondary container, it is vitally important that a proper sealing of this catalyst from the resin material in the can be effected. In addition, it is important that the inertia means in the form of a weight be appropriately "caged" so as to prevent accidental shattering of the secondary container. Finally, it would be desirable in the structure as set forth in my referred to U.S. patent if the can could be manufactured without having to incorporate any alterations whatsoever for supporting the secondary container.

BRIEF DESCRIPTION OF THE PRESENT INVENTION

Bearing the foregoing considerations in mind, the present invention contemplates an improved portable spray can for dual liquids over that shown and described in my prior U.S. Pat. No. 3,591,089 wherein improved sealing of the catalyst from the resinous material is provided and simultaneously a more reliable "caging" of the inertial weight results. In addition, the present invention provides a novel mounting of the secondary container to the spray means tube itself so that these structures can be inserted as a unit into a conventional spray can. As a consequence, no alterations or auxiliary structures are necessary in the spray can itself for supporting the secondary container.

BRIEF DESCRIPTION OF THE DRAWINGS

A better understanding of the present invention will be had by now referring to the accompanying drawings in which.

DETAILED DESCRIPTION OF THE PREFERRED EMBODIMENT

Figure 1:
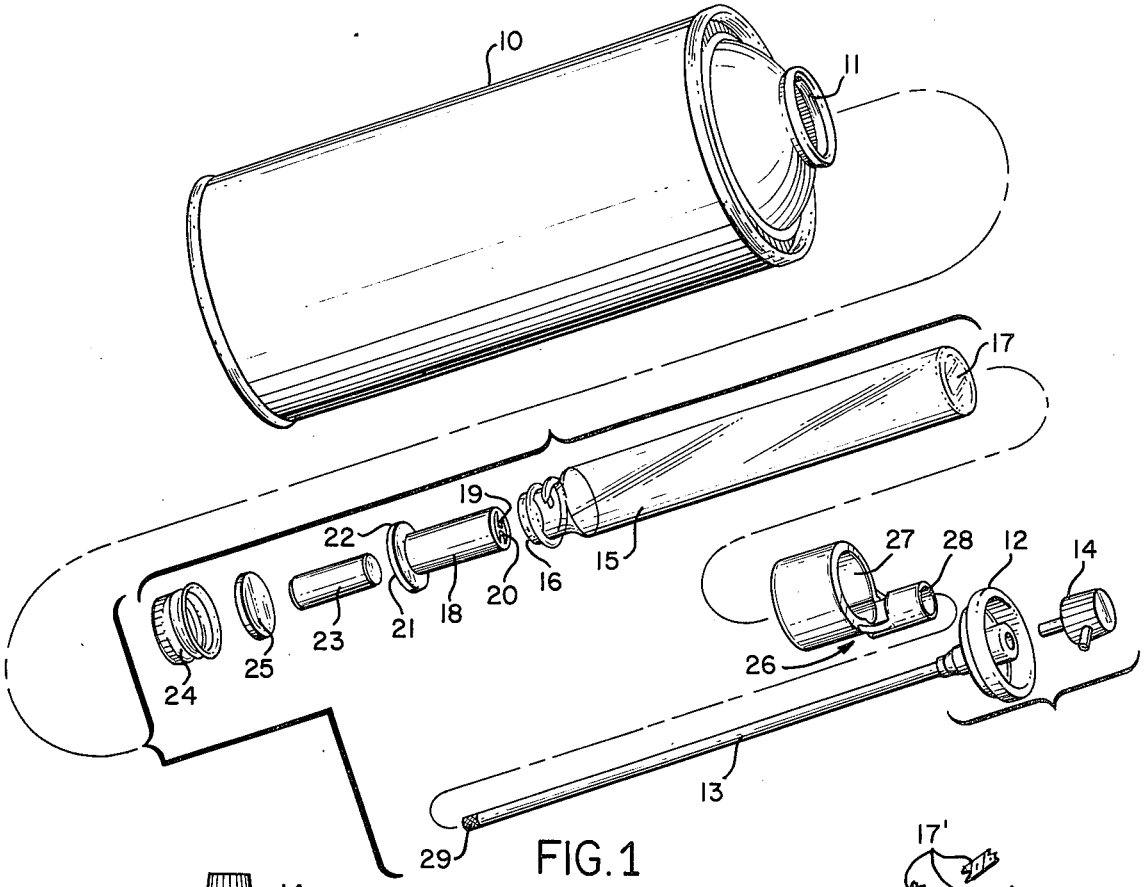
FIG. 1 is an exploded perspective view illustrating the various components making up the improved spray can of this invention.

Referring first to FIG. 1 there is shown a portable spray can 10 having a neck opening 11 all of conventional design.

Cooperating with the spray can 10 is a spray means 12 shown exploded away in the lower right portion of FIG. 1 including an elongated tube 13 arranged to pass into the neck 11 of the can 10 to extend downwardly therein. The spray valve operating button is shown exploded at 14 for the spray means.

In accord with the present invention, there is also provided an elongated cylindrical secondary container 15 made of frangible material such as glass, by way of example, also arranged to be received in the interior of the can with its longitudinal axis running substantially longitudinally in the can. One end 16 of this secondary container is open and its other end 17 closed.

Shown in a position to be received within the open end 16 of the secondary container 15 is a cylindrical plastic cartridge member 18 having flexible fingers 19 and 20 transversely extending across one end and its other end 21 open and defining an annular flange 22 about this open end. The one end of the cartridge including the flexible fingers 19 and 20 is receivable in the one end 16 of the secondary container 15 in such a manner that the annular flange 22 will seat on the periphery of the open end 16 of the secondary container.

Shown further in exploded relationship is a weight 23 receivable in the open end 21 of the cartridge 18. A cap 24 is threadedly receivable over the open end 16 of the secondary container 15, there being provided a sealing disc 25 of plastic material for seating on the annular flange 22 to provide a seal when the cap 24 is in place. Thus, the disc 25 fits on the inside end surface of the cap 24 for seating on the annular flange 22.

The plastic cartridge 18, cap 24 and disc 25 constitute a closure means for the one open end 16 of the frangible secondary container 15, this closure means not only functioning as a seal for corrosive liquid in the container 15 but also serving to "cage" the weight 23 in one end of the secondary container. Thus, the flexible fingers 19 and 20 effectively restrain movement of the weight 23 until a given inertial force caused by vigorous shaking of the can is exceeded at which point, the inertia force generated is sufficient to flex the fingers 19 and 20 apart and release the weight for movement along the secondary container 15.

In order that the can 10 can be manufactured in its usual form without any modifications, a feature of this invention includes an integral plastic member 26 defining a first collar 27 arranged to surround the secondary container 15 and a second collar 28 arranged to receive the elongated tube 13 thereby mounting the secondary container to the spray means so that the tube and secondary container can be inserted in the can as a unit.

A final component in accord with a preferred embodiment of this invention constitutes a screen 29 at the lower end of the elongated tube 13 for blocking fragments of the secondary container 15 after shattering of the same by the weight 23 from passing out through the tube 13 in a spray operation.

Figure 2:
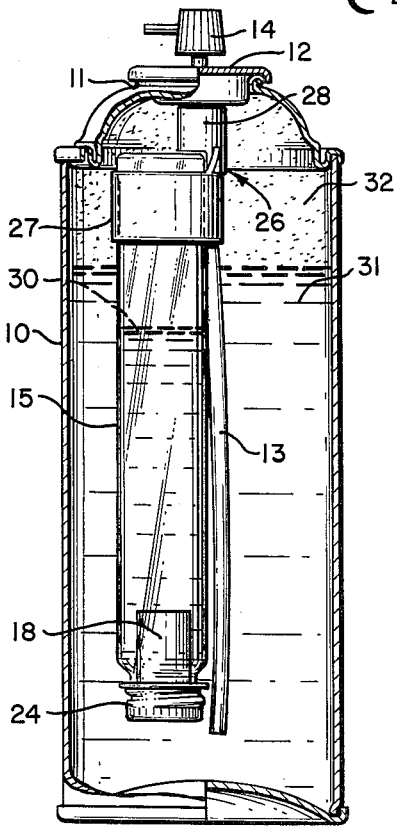
FIG. 2 is a side elevational view partly in cross section showing the various components of FIG. 1 in assembled relationship.

All of the foregoing will become clearer by now referring to FIG. 2 illustrating partially in cross section the assembled components described. Thus, it will be noted that the secondary container 15 is held substantially in the central portion of the can 10 by the plastic member 26, the respective collars 27 and 28 surrounding the secondary container 15 and tube 13 respectively. The plastic material making up member 26 may constitute nylon and is stretchable so that the secondary container 15 is readily frictionally held within the collar 27 but may be easily removed and inserted therein. It will be appreciated that the secondary container and spray assembly including the spray valve structure 12, elongated tube 13 and operating push button 14 can be inserted through the neck 11 of the can 10 as a unit during assembly.

In the above described manufacture, the secondary container 15 is filled with an appropriate catalyst designated 30 after which the cap 24 is threaded in place in cooperation with the plastic cartridge 18 containing the weight 23. The material making up the plastic cartridge 18 is preferably polyethylene of high density. The material making up the cooperating sealing disc 25 described in FIG. 1 is of low density polyethylene. Contact between these two materials upon tightly threading the cap 24 provides an excellent seal for the catalyst liquid 30 in the secondary container 15.

As also indicated in FIG. 2, the can 10 itself is filled with a different liquid such as a resin paint, the upper portion of the can containing an appropriate gas propellant indicated at 32 under pressure.

Figure 3:
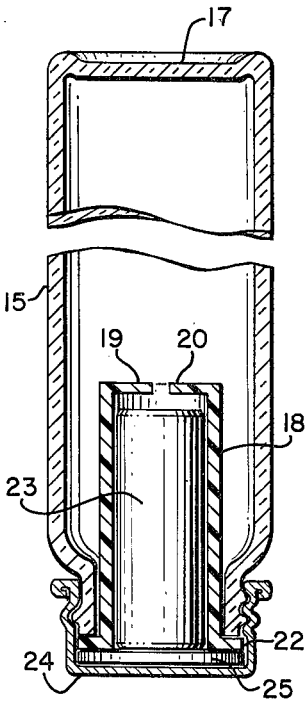
FIG. 3 is a greatly enlarged view of the lower portion of the secondary container shown in FIG. 2 with associated components in a normal position; and, FIG. 4 is a view similar to FIG. 3 but illustrating movement of one of the components upon shaking of the spray can for the purpose of shattering the secondary container.

Referring to the enlarged view of FIG. 3, the seating of the annular flange 22 of the plastic cartridge 18 on the disc 25 secured within the interior end of the cap 24 is clearly illustrated. Further, the normal unflexed positions of the fingers 19 and 20 are shown "caging" the weight 23 within the plastic cartridge 18.

Figure 4:
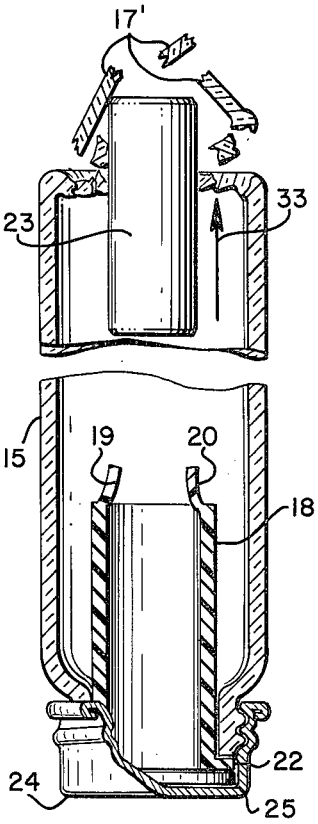

FIG. 4 illustrates the same components as disclosed in FIG. 3 except that the can has been shaken generally along the longitudinal axis such as to generate an inertial force sufficient to release the weight 23 from the plastic cartridge 18 by flexing of the fingers 19 and 20 outwardly such that the weight 23 can travel along the secondary container 15. In FIG. 4, the weight is shown impacting the closed end of the secondary container 15 to fracture or shatter the same, the shattered particles being indicated at 17'. The movement of the weight 23 along the tube is indicated by the arrow 33 in FIG. 4.

OPERATION

The spray can during its manufacture is provided with appropriate catalyst and resin chemicals as described. A customer may then simply purchase the can in the condition illustrated in FIG. 2 and when he desires to effect a painting or other type of coating operation, it is only necessary for him to vigorously shake the can generally along its longitudinal axis thereby generating sufficient inertial force to cause the weight 23 to bias apart the flexible fingers 19 and 20 of the plastic cartridge 18 to release the weight and cause shattering of the end of the secondary container as shown in FIG. 4.

After the secondary container is shattered, further shaking of the can will mix the chemical ingredients. In this respect, the weight 23 will be free to move about the interior of the can and will aid in the mixing. Thereafter, the user will then depress the spray means push button 14 to actuate the valve and the mixture will pass out the spray nozzle 19 under pressure existing as a consequence of the gas propellant 32 of FIG. 2. This propellant may be in a partially liquid state and a partially gaseous state. Sufficient pressure is maintained by using a propellant such as Freon or an equivalent liquid with a low boiling point. The screen 29, as described heretofore, will prevent any fragments of the secondary container from passing up the tube 13.

Normally, the operator will use up the entire contents during a single painting or spraying operation, the can then simply being thrown away.

From all of the foregoing, it will be evident that the present invention has provided an improved spray can over the structure described in my previously issued U.S. Pat. No. 3,591,089, wherein the present invention provides improved sealing of the catalyst from the liquid in the can as well as improved "caging" of the weight and in addition an appropriate coupling for mounting the secondary container to the spray apparatus itself so that no modification whatsoever is required of the can.

I claim:

1. A portable spray can for dual liquids comprising in combination:

(a) an elongated cylindrical can having spray means including an elongated tube passing into said can and extending downwardly therein;

(b) an elongated cylindrical secondary container of frangible material in the interior of said can with its longitudinal axis running substantially longitudinally in said can, one end of said secondary container being open and its other end closed;

(c) a cylindrical plastic cartridge member having flexible fingers transversely extending across one end and its other end open and defining an annular flange about said open end, said one end of said cartridge being received in said one end of said secondary container with said annular flange seating on the periphery of the open end of said secondary container;

(d) a weight received in said cartridge;

(e) a cap threadedly receivable over the open end of said secondary container;

(f) a sealing disc inside said cap of plastic material for seating on said annular flange to provide a seal when said cap is in place;

(g) an integral plastic member defining a first collar surrounding said secondary container and a second collar surrounding said elongated tube to thereby mount said secondary container to said spray means so that the tube and secondary container can be received in said can as a unit, said weight being retained in said cartridge by said flexible fingers, said fingers being biased apart to release said weight for movement along said secondary container in response to a given inertial force generated by shaking said can back and forth generally in the direction of said longitudinal axis said weight having sufficient mass to shatter said secondary container when it impacts the closed end thereof, said secondary container including a catalyst and said can containing a resinous liquid and gas propellant to be mixed with said catalyst whereby shaking of the can back and forth causes said weight to be released and shatter said secondary container and place said catalyst into communication with said resinous liquid and gas propellant; and (h) a screen at the lower end of said elongated tube for blocking any fragments of said secondary container from passing up through said tube during a spray operation.

* * * * *